US005645482A

United States Patent [19]

Moss et al.

[11] Patent Number: 5,645,482

[45] Date of Patent: Jul. 8, 1997

[54] CLOSE COUPLED CONTRACTIBLE VENT CONNECTOR

[75] Inventors: William R. Moss; John L. Andersen, both of Jacksonville, Tex.

[73] Assignee: Builder's Best Inc., Jacksonville, Tex.

[21] Appl. No.: 705,636

[22] Filed: Aug. 30, 1996

[51] Int. Cl.[6] ..... F24F 7/00

[52] U.S. Cl. ..... 454/339; 34/235; 454/359

[58] Field of Search ..... 34/235; 454/339, 454/337, 359, 341; 285/67, 73, 79, 18, 330, 298, 302

[56] References Cited

U.S. PATENT DOCUMENTS

| | | | |
|---|---|---|---|
| 31,652 | 3/1861 | Bell . | |
| D. 218,825 | 9/1970 | Blummer | D23/1 |
| 258,311 | 5/1882 | Neilson . | |
| 305,365 | 9/1884 | Wickersham | 454/339 |
| 317,353 | 5/1885 | Hayes . | |
| 323,317 | 7/1885 | Goodrich . | |
| 732,497 | 6/1903 | Amos . | |
| 831,429 | 9/1906 | Harington . | |
| 1,272,064 | 7/1918 | Lezius | 454/359 |
| 2,044,761 | 6/1936 | Becvar | 126/307 |
| 3,511,252 | 5/1970 | Kennedy | 134/145 |
| 3,892,049 | 7/1975 | Adams, Jr. | 34/235 |
| 4,969,276 | 11/1990 | Walsh | 34/90 |
| 5,121,948 | 6/1992 | Anderson et al. | 285/168 |
| 5,257,468 | 11/1993 | Lebrun | 34/235 |

*Primary Examiner*—Henry A. Bennett
*Assistant Examiner*—Dinnatia Doster
*Attorney, Agent, or Firm*—Price, Heneveld, Cooper, DeWitt and Litton

[57] ABSTRACT

A telescopically extensible-contractible air duct connector comprising an elongated outer duct element having an open end, a closed end, and a lateral opening adjacent the closed end, an inner duct element telescopically interfitting within the outer duct element, having an open end within the outer duct element, a closed end located outside the outer duct element, a lateral opening adjacent the closed end, and a laterally projecting sleeve around the lateral opening, the outer duct element having an elongated slot extending from the open end and of a width slightly greater than that of the laterally projecting sleeve of the inner duct element to receive the sleeve upon telescopic contraction of the connector, and the inner duct element having an extended panel within the outer duct element, adjacent the slot, and of a width greater than the width of the slot to cover the slot when the connector is at least partially extended.

14 Claims, 2 Drawing Sheets

CLOSE COUPLED CONTRACTIBLE VENT CONNECTOR

BACKGROUND OF THE INVENTION

This invention relates to air flow duct connectors as for use on clothes dryers and the like.

Air flow duct systems for venting exhaust air from clothes dryers must adapt to a variety of physical positions between the dryer air outlet and the opening in the adjacent wall. This is because each installation typically encounters a different lateral spacing between the outlet on the dryer and the opening in the wall. One duct component which is used to accommodate certain of these dimensional relationships is a telescopically expandable and contractible, two-piece sheet metal rectangular tube assembly with side openings, sometimes called a "periscope" connector because of its visual resemblance to an actual optical periscope. This type of connector is formed of two tubes which are telescopically interfitted, each having a lateral orifice and a lateral sleeve around the orifice. There is a significant limit in the amount of contraction possible with these known commercial connectors because one of the sleeves abuts the end of the other tube. Typically the smallest spacing achievable is six inches, center to center of the sleeves and orifices, but this length does not allow for any telescopic adjustment without making the connection wobbly. Thus, if the dryer outlet is displaced laterally less than this amount, a periscope connector cannot normally be employed. If a longer connector is supplied but the distance to be met is shorter, one of the telescopic tubes must be cut shorter, but cutting a metal tube can be difficult and therefore is usually not done. The installer will be tempted to substitute a piece of flexible plastic duct, but this increases the risk of fire. The minimum spacing between the air flow openings in a conventional connector is actually a function of the maximum spacing of the openings. Presently, assuming a two inch minimum overlap for proper strength of the telescopic connector, to accommodate the widest variations of 6¼" to 22" spacing of the dryer outlet to the wall outlet, it is necessary to have several telescopic connector lengths available, e.g., 6¼" to 6½", 6½" to 7", 8" to 10", 10" to 14", and 14" to 22". Therefore, connecting the dryer to the outlet with a proper metal connector meeting fire safety standards and of a proper length can present a significant problem and usually requires availability of several connectors of different lengths. This is not currently available due to the cost and impracticality of so many connectors.

A typical type of telescopic connector is shown in Des. 218,825 to Blumer. Use of such a typical telescopic connector on a gas range is shown in U.S. Pat. No. 2,044,761 to Becvar.

What is needed in the trade is a telescopic air flow duct connector capable of having its inlet and outlet openings variably movable from a significantly wide spacing down to a relatively small spacing so as to accommodate incremental spacing between these two extremes. Moreover, at all of these positions there must not be any significant dead air space adjacent the openings, or lint will collect there and present a potential fire hazard.

SUMMARY OF THE INVENTION

An object of this invention is to provide a single novel extensible/contractible air flow duct connector which is actually expandable to a maximum length of the two interfitting components, and yet contractible down to a small offset of the two lateral air flow openings of the connector, but having no significant dead air space adjacent the openings for lint to collect and present a potential fire danger, regardless of the relative adjusted positions of the lateral openings.

The connector is formed of two slidingly interfittable, elongated, inner and outer duct elements, each duct element having one closed end and a closely adjacent lateral air flow opening and lateral sleeve. Preferably, the resulting connector is rectangular in cross section, having two wider sides and two narrower sides, the wider sides being opposite each other and the narrower sides being opposite each other. Other cross sectional configurations are also possible. Of the two telescopically interfit duct elements, the inner duct element is smaller than the outer to telescopically fit therein. The outer element has a slot in its wide wall that is opposite the wide wall containing its opening and sleeve. The slot is of a width slightly greater than the diameter of the sleeve on the inner duct element, and having a length allowing the inner duct sleeve to move into the slot during contraction of the connector. The inner duct element has three of its walls foreshortened and its fourth wall including an elongated panel of a width to cover this slot. This panel can be conveniently and easily trimmed to a length desired to produce a connector of desired length and orifice offset. The panel preferably has a pair of flanges which interengage with offsets in the outer element.

These and other features, advantages and objects of the present invention will be further understood and appreciated by those skilled in the art by reference to the following specification, claims and appended drawings.

The terms "top," "bottom," "front," "back," and "side" are used herein for convenience and clarity of understanding of the invention, with the top view representing what one would see by looking down on the connector in position behind the back of a clothes dryer, and with the inner element connected to the wall duct outlet (not shown) and the outer element connected to the dryer warm discharge air outlet (not shown) for transfer of the air to the exterior of the building. However, it will be understood that the connector can be placed in any position and orientation. Therefore, these terms of convenience are not intended to be limiting terms.

DESCRIPTION OF PREFERRED EMBODIMENT

Figure 3:
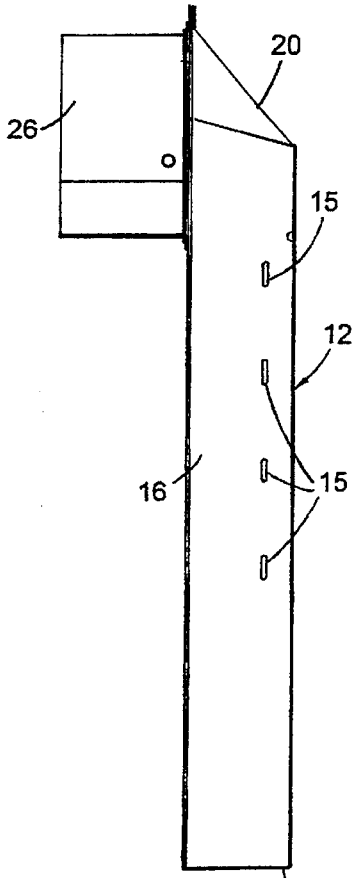
FIG. 3 is a top view of the outer duct element in FIGS. 1 and 2.

Referring now specifically to the drawings, the air duct connector assembly 10 is composed of an elongated outer duct element 12 and an elongated inner duct element 14. These two duct elements are telescopically interfit with each other, the inner element within the outer element, the inner element being of a slightly smaller size to closely interfit with the outer element. Outer element 12 is preferably formed of rectangular cross sectional configuration, having four sheet metal walls forming a duct or tube, and shown to be of a pair of opposite, like narrow walls 16 and a pair of opposite wider walls 18 and 18'. One end 20 of the outer element is closed while the opposite end 22 (FIG. 3) is open to receive the inner element 14. Immediately adjacent closed end 20 is a lateral circular orifice or opening 24 in wall 18, surrounded by a laterally extending cylindrical sleeve 26 which is connected to wall 18 by a conventional sheet metal swivel joint. Sleeve 26 fits onto the dryer outlet (not shown) to receive air from the dryer. End 20 is diagonally oriented relative to opening 24 such that air from sleeve 26 will strike this sloped surface and be deflected lengthwise of the connector. There is no significant dead end space adjacent end 20 to collect lint. The diagonally deflected air sweeps lint to the outlet.

Figure 4:
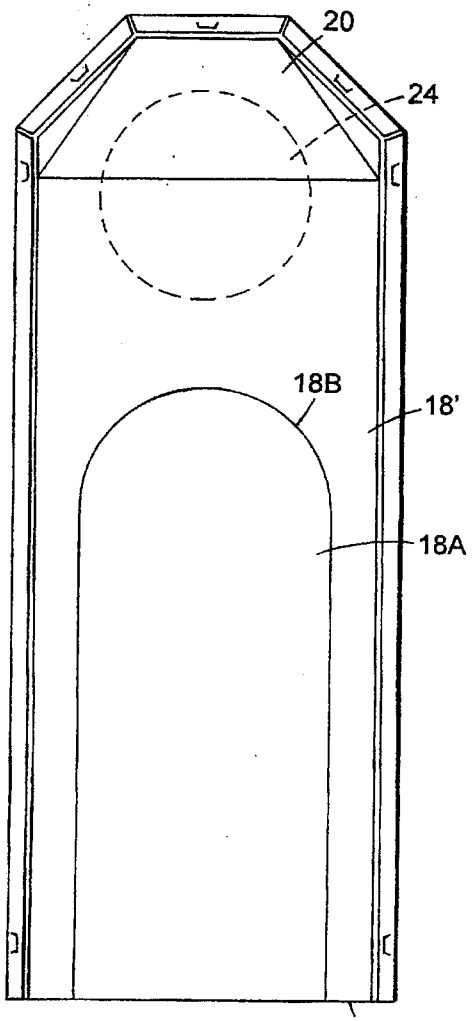
FIG. 4 is a somewhat enlarged back view of the outer element in FIG. 3.
Figure 5:
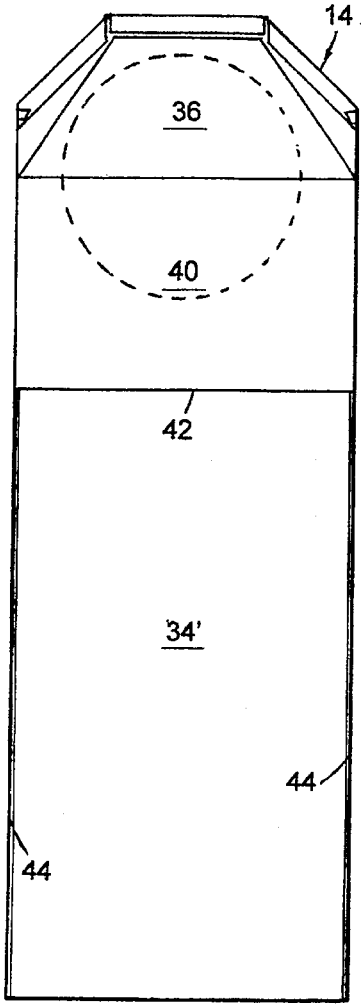
FIG. 5 is a front view of the inner element in FIG. 1.

In wall 18' is an elongated slot 18A (FIG. 4) which extends from the open end 22 of the outer member, the two parallel edges on opposite sides of the slot terminating in an arc 18B at the inner end of the slot. This arc preferably has a diameter which is slightly larger than the diameter of the cylindrical sleeve 30 projecting from one of the wide walls of inner element 14.

Figure 1:
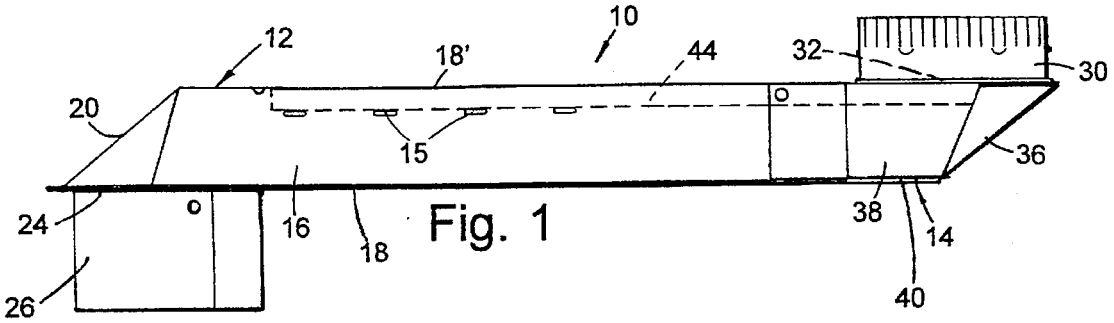
FIG. 1 is a top view of the connector of this invention shown in its extended condition.
Figure 6:
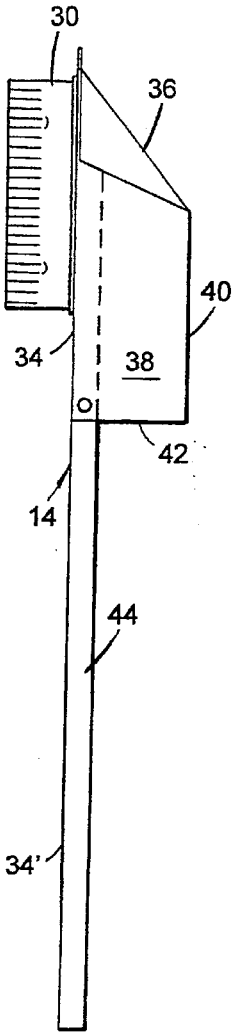
FIG. 6 is a top view of the inner element in FIG. 5.
Figure 7:
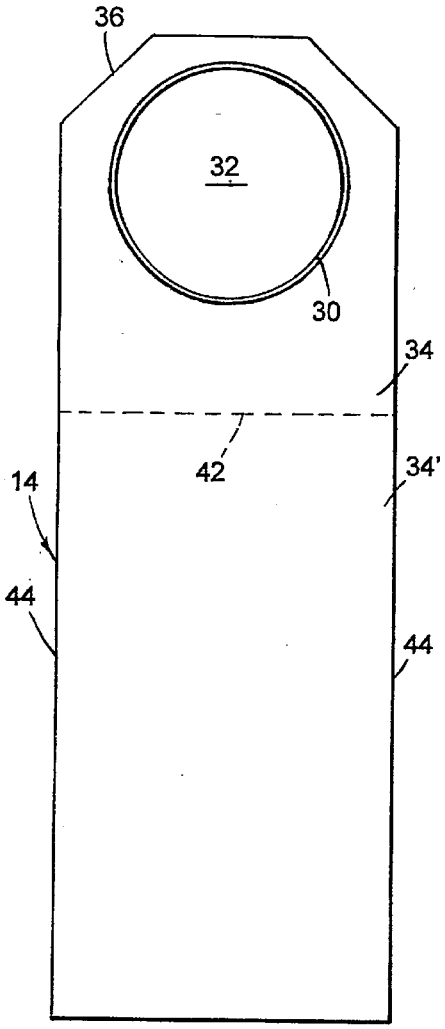
FIG. 7 is a back view of the inner element in FIGS. 5 and 6.

Sleeve 30 is shown to be cylindrical in configuration, surrounding a circular side opening 32 (FIG. 7) in an elongated wall panel 34' which forms an extension of one wall 34 of element 14. Sleeve 30 is attached to wall 34 with a conventional sheet metal swivel joint. The end 36 of inner element 14 is closed adjacent opening 32. Three of the four walls on this inner element 14 are foreshortened, i.e., the narrow side walls 38 and the one wide wall 40, while wall 34 is elongated relative to the other three to form a panel 34' for specific reasons to be described hereinafter. Extending normal to wall panel 34' is a pair of opposite, parallel flanges 44 (FIGS. 1 and 6). These flanges engage the inner surfaces of side walls 16 of outer element 12 because the width of the inner element is slightly smaller than the internal width of the outer element 14 to slidingly telescopically interfit therewith. Closed end 36 is diagonally oriented toward opening 32 to provide a smooth deflecting surface for air flow through sleeve 30 into the wall outlet (not shown). There is no significant dead air space adjacent end 36 to collect lint. The diagonally deflected air sweeps lint through the duct. Three of the four walls of inner element 14 terminate at open end 42 of inner element 14.

Impressed into the two narrow side walls 16 of outer element 12 are a plurality of aligned indentations (FIGS. 1, 2 and 3) to form bosses 15 on the opposite inside faces of walls 16. These bosses engage the distal edges of flanges 44 and thereby keep panel 34' against wall 18' of outer element 12. Panel 34' is wider than slot 18A so as to cover this slot from side to side. The exact length of panel 34' can be chosen and achieved as by removing portions of its length with a pair of tin snips, as will be understood more fully hereinafter.

Figure 2:
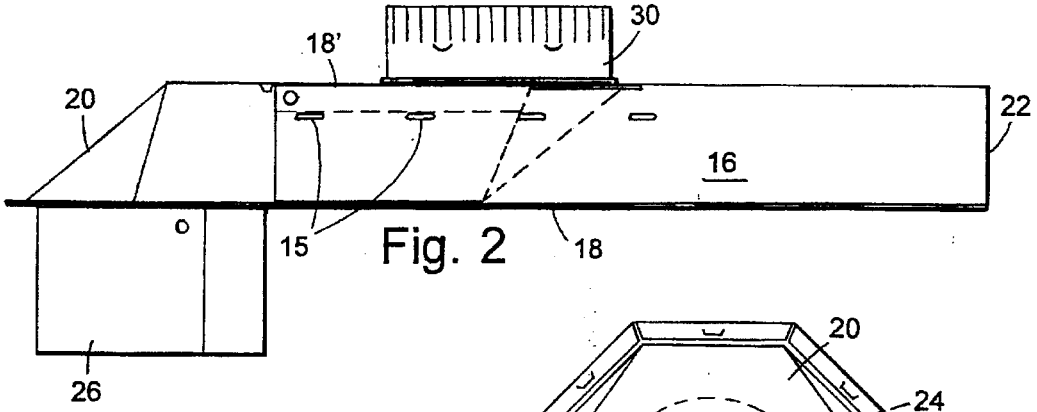
FIG. 2 is a top view of the duct connector in FIG. 1 shown in a contracted condition.

When the inner and outer elements are telescopically interfitted with each other, the length of the resulting connector, i.e., the offset between the centerline of inlet sleeve 26 and outlet sleeve 30 can be chosen to suit a particular installation of dryer. Thus, the connector can be at the maximum length shown in FIG. 1 where it is extended, panel 34' thus covering the length of slot 18A such that warm air can enter through sleeve 26, be deflected by diagonal end 20 through the closed connector, deflected by diagonal closed end 36, out outlet sleeve 30 to a discharge pipe. However, if the dryer outlet and the wall outlet are closer together, the structure can be telescopically contracted. For very small offset amounts, portions of panel 34' can be readily removed by tin snips to cause sleeve 30 to be closely spaced from sleeve 26 as depicted in FIG. 2. Removal of portions of panel 34' is simple since it is not a closed tube, so that a pair of tin snips can readily cut through one of the flanges 44, across panel 34' and then the other flange 44. Then sleeve 30 can be slid even up to the complete length of slot 18A until it engages the arcuate end 18B to maximize contraction of the connector. Thus, the amount of contraction of the fitting can be varied with each installation so as to be adaptable to the particular location of dryer outlet relative to wall outlet. The two sleeves project in opposite directions to interfit with the respective dryer outlet and wall outlet.

Those in this field may conceive of minor variations of the preferred embodiment set forth herein as exemplary. Thus, the invention is not intended to be limited to the preferred illustrative embodiment, but only by the scope of the following claims and the equivalents thereto.

The embodiments of the invention in which an exclusive property or privilege is claimed are defined as follows:

1. A telescopically extensible-contractible air duct connector comprising:

an elongated outer duct element having an open end, a closed end, and a lateral opening adjacent said closed end;

an inner duct element telescopically interfitting within said outer duct element, having an open end within said outer duct element, a closed end located outside said outer duct element, a lateral opening adjacent said closed end, and a laterally projecting sleeve around said lateral opening;

said outer duct element having an elongated slot extending from said open end and of a width slightly greater than that of said laterally projecting sleeve of said inner duct element to receive said laterally projecting sleeve of said inner duct element upon telescopic contraction of said connector; and said inner duct element having an extended panel within said outer duct element, adjacent said slot, and of a width greater than the width of said slot to cover said slot when said connector is at least partially extended.

2. The telescopically extensible-contractible air duct connector in claim 1 wherein said outer duct element has four elongated walls, said elongated slot being in one of said elongated walls, and said inner duct element having three shortened walls and one elongated wall forming said extended panel.

3. The telescopically extensible-contractible air duct connector in claim 2 wherein said laterally projecting sleeve is cylindrical and said elongated slot has parallel edges terminating in an arc that has a diameter substantially corresponding to that of said sleeve.

4. The telescopically extensible-contractible air duct connector in claim 2 wherein said panel has a pair of edge flanges generally normal to said panel, and engaging opposite walls of said outer duct element for alignment of said duct elements.

5. The telescopically extensible-contractible air duct connector in claim 4 wherein said opposite walls of said outer duct element have bosses engageable with said flanges to keep said panel adjacent said slot.

6. The telescopically extensible-contractible air duct connector in claim 1 wherein said outer duct element lateral opening has a laterally projecting sleeve therearound, projecting in a direction opposite that in which said inner duct element lateral sleeve projects.

7. The telescopically extensible-contractible air duct connector in claim 6 wherein said panel and said elongated slot are opposite said outer duct element lateral sleeve.

8. The telescopically extensible-contractible air duct connector in claim 2 wherein said inner duct element laterally projecting sleeve is on the same wall as said elongated panel.

9. The telescopically extensible-contractible air duct connector in claim 1 wherein said outer element closed end is diagonally sloped toward said outer element lateral opening.

10. The telescopically extensible-contractible air duct connector in claim 9 wherein said inner element closed end is diagonally sloped toward said inner element lateral opening.

11. A telescopically extensible-contractible air duct connector comprising:

an elongated outer duct element having an open end, a closed end, and a lateral opening adjacent said closed end;

said outer element closed end being diagonally sloped toward said outer element lateral opening;

an inner duct element telescopically interfitting within said outer duct element, having an open end within said outer duct element, a closed end located outside said outer duct element, a lateral opening adjacent said closed end, and a laterally projecting sleeve around said lateral opening;

said inner element closed end being diagonally sloped toward said inner element lateral opening;

said outer duct element having an elongated slot extending from said open end and of a width slightly greater than that of said laterally projecting sleeve of said inner duct element to receive said laterally projecting sleeve of said inner duct element upon telescopic contraction of said connector;

said inner duct element having an extended panel within said outer duct element, adjacent said slot, and of a width greater than the width of said slot to cover said slot when said connector is at least partially extended; and said outer duct element having four elongated walls, said elongated slot being in one of said elongated walls, and said inner duct element having three shortened walls and one elongated wall forming said extended panel.

12. The telescopically extensible-contractible air duct connector in claim 11 wherein said laterally projecting sleeve is cylindrical and said elongated slot has parallel edges terminating in an arc that has a diameter substantially corresponding to that of said sleeve.

13. The telescopically extensible-contractible air duct connector in claim 11 wherein said panel has a pair of edge flanges generally normal to said panel, and engaging opposite walls of said outer duct element for alignment of said duct elements, said opposite walls of said outer duct element having bosses engageable with said flanges to keep said panel adjacent said slot.

14. The telescopically extensible-contractible air duct connector in claim 11 wherein said outer duct element lateral opening has a laterally projecting sleeve therearound, projecting in a direction opposite that in which said inner duct element lateral sleeve projects; said panel and said elongated slot being opposite said outer duct element lateral sleeve; and said inner duct element sleeve being on the same wall as said elongated panel; said outer element closed end being diagonally sloped toward said outer element lateral opening; and said inner element closed end being diagonally sloped toward said inner element lateral opening.

* * * * *